US006886321B2

(12) United States Patent
Sonntag et al.

(10) Patent No.: US 6,886,321 B2
(45) Date of Patent: May 3, 2005

(54) CONDUIT PLATE ADAPTER FOR AN OPEN-END SPINNING DEVICE

(75) Inventors: Eckhard Sonntag, Waiblingen (DE); Rolf Danner, Ebersbach (DE); Claus-Dieter Landolt, Mönchengladbach (DE); Michael Spitzer, Korschenbroich (DE); Brigitte Riede, Mönchengladbach (DE)

(73) Assignee: W. Schlafhorst AG & Co., Monchengladbach (DE)

( * ) Notice: Subject to any disclaimer, the term of this patent is extended or adjusted under 35 U.S.C. 154(b) by 20 days.

(21) Appl. No.: 10/447,567

(22) Filed: May 29, 2003

(65) Prior Publication Data

US 2003/0221406 A1 Dec. 4, 2003

(30) Foreign Application Priority Data

May 31, 2002 (DE) ..... 102 24 205

(51) Int. Cl.[7] ..... D01H 4/08
(52) U.S. Cl. ..... 57/404; 57/417
(58) Field of Search ..... 57/404–417

(56) References Cited

U.S. PATENT DOCUMENTS

| | | | | |
|---|---|---|---|---|
| 4,584,833 A | | 4/1986 | Dykast et al. | 57/405 |
| 4,854,119 A | | 8/1989 | Stahlecker et al. | 57/417 |
| 5,794,430 A | * | 8/1998 | Grecksch et al. | 57/417 |
| 5,953,896 A | | 9/1999 | Stahlecker | 57/404 |
| 5,987,870 A | * | 11/1999 | Wassenhoven et al. | 57/406 |
| 6,035,623 A | * | 3/2000 | Wassenhoven et al. | 57/406 |
| 6,035,625 A | * | 3/2000 | Schlomer et al. | 57/417 |
| 6,240,717 B1 | * | 6/2001 | Riede | 57/406 |
| 6,289,663 B1 | * | 9/2001 | Schroder | 57/406 |

FOREIGN PATENT DOCUMENTS

| | | |
|---|---|---|
| DE | 33 43 216 A1 | 6/1985 |
| DE | 40 07 517 A1 | 12/1991 |
| DE | 42 05 485 A1 | 8/1993 |
| DE | 43 03 336 A1 | 8/1994 |
| DE | 43 34 485 A1 | 4/1995 |
| DE | 195 32 735 A1 | 3/1997 |
| DE | 195 44 617 A1 | 6/1997 |
| DE | 197 55 060 A1 | 6/1999 |
| DE | 199 26 675 A1 | 12/2000 |
| DE | 100 57 982 A1 | 6/2001 |
| EP | 1 072 701 A1 | 1/2001 |

OTHER PUBLICATIONS

European Search Report.
German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A conduit plate adapter for use with an open-end spinning device, comprising a base body having a central passage bore extending therethrough and a yarn withdrawal nozzle mouth fixedly secured directly in the central passage bore. The conduit plate adapter of the present invention is removably inserted into a conduit plate.

20 Claims, 4 Drawing Sheets

CONDUIT PLATE ADAPTER FOR AN OPEN-END SPINNING DEVICE

CROSS-REFERENCE TO RELATED APPLICATIONS

This application claims the benefit of German Patent Application No. 102 24 205.4, filed May 31, 2002, hereby incorporated herein by reference.

BACKGROUND OF THE INVENTION

The present invention relates to a conduit plate adapter suitable for use in an open-end spinning device.

Conduit plate adapters are known, for example in German Patent Publication DE 43 34 485 A1. Such conduit plate adapters comprise preferably a circular base body with a conically designed contact surface on its back side and having a mouth that extends into a spinning rotor during spinning operations. The mouth of the conduit plate adapters has dimensions that are adapted to a certain spinning-rotor diameter or to a diameter range. A mouth of a yarn guide conduit is inserted into the mouth of the conduit plate adapter. A centrally arranged yarn withdrawal nozzle is also present.

Previously known conduit plate adapters further comprise a central passage bore into which a yarn withdrawal nozzle is fixed in a replaceable manner at an entrance side and into which a yarn withdrawal tube engages on an exit side opposite the entrance side.

The yarn withdrawal nozzle replaceably fixed in the central passage bore typically comprises of a special holding body and a ceramic nozzle mouth fastened in a non-detachable manner to the holding body, as disclosed in German Patent Publication DE 195 44 617 A1. The holding body, which is generally ferromagnetic, engages permanent magnet inserts that are disposed in the conduit plate adapter, thus fixing the holding body in the conduit plate adapter in a non-positive manner.

These conduit plate adapters, which are well known, have proven themselves in practice and make it possible to create optimal spinning conditions in open-end spinning devices. For example, if the spinning rotors are replaced by smaller spinning rotors during a batch change, then the conduit plate adapters can also be replaced in a relatively simple manner by conduit plate adapters with an adapted mouth. Moreover, in such a batch change, the spinning material can also be taken into consideration by appropriately selecting the yarn withdrawal nozzle, that is arranged in a readily replaceable manner in the conduit plate adapter. Further, the spinning of the yarn can be influenced via the imparting of a false twist.

However, these previously known conduit plate adapters have the disadvantage that they are quite expensive to manufacture and use. In addition, it can occur in exceptional instances, especially in the case of difficult yarns, that the magnetic attachment of the yarn withdrawal nozzle fails to hold sufficiently and the yarn withdrawal nozzle rotates in its receiving central passage bore, which has a negative effect on the yarn being produced.

The present invention attempts to overcome the disadvantages of the previously cited state of the art by creating a conduit plate adapter that is economical to manufacture and is also reliable to operate.

SUMMARY OF THE INVENTION

The present invention addresses the above discussed disadvantages by providing a conduit plate adapter that comprises a base body having a central passage bore extending therethrough and a yarn withdrawal nozzle mouth fixedly secured directly in the central passage bore. The conduit plate adapter of the present invention is removably inserted into the conduit plate.

The present invention has the particular advantage that by eliminating a special holding body and fixing the nozzle mouth directly in the central passage bore of the conduit plate adapter, the manufacturing costs of such conduit plate adapters can be significantly reduced. Thus, the conduit plate adapter becomes so advantageous that it is economical to store multiple completely equipped conduit plate adapters and to simply replace the complete conduit plate adapter when required. The fixing of the nozzle mouth directly in the central passage bore not only results in a very secure connection but, in addition, the dimensions of the mouth of the conduit plate adapter can be minimized. As the mouth of the conduit plate adapter extends into the spinning rotor during spinning operation, such minimizing is particularly useful in the case of spinning rotors with a small diameter and makes it possible to use spinning rotors with a diameter substantially less than 30 mm. Preferably, the nozzle mouth is manufactured from a ceramic material.

In a preferred embodiment, the nozzle mouth is undetachably secured to the central passage bore by press fitting the nozzle mouth into a receptacle opening formed in the central passage bore at an inlet side of the central passage bore. The pressing in of the nozzle mouth not only constitutes a secure and economical connecting method but also allows the nozzle mouth to be centered within the central passage bore, which has a positive effect on the yarn to be withdrawn.

In another embodiment, the nozzle mouth is secured within the receptacle opening of the central passage bore by an adhesive. Securing the nozzle mouth in this manner represents a secure, undetachable connecting method that can be performed economically.

In a preferred embodiment, a sensor is arranged in the area of the central passage bore, preferably following the nozzle mouth, for monitoring the yarn traveling through the central passage bore.

In a preferred embodiment, a wear protection sleeve is arranged in the central passage bore, oriented along the direction of travel of the withdrawn yarn passing through the central passage bore. The wear protection sleeve protects that central passage bore from being abraded by the yarn passing therethrough. This wear protection sleeve is manufactured from a highly wear-resistant material, for example a ceramic material, a hard metal or a plasma-nitrided material. The service life of the conduit plate adapter can be significantly extended by using such a wear protection sleeve.

In a preferred embodiment, a twirling insert may be used separately or in combination with the wear protection sleeve. The twirling insert, disposed within the central passage bore mechanically imparts a false twist to the yarn to be withdrawn which has an advantageous effect on the stability of the spinning of the open-end spinning device.

Alternatively, a false twist blast nozzle device may be installed in the central passage bore to pnuematically impart a false twist to the withdrawn yarn. As with the mechanical twirling insert, a false twist blast nozzle device advantageously increases the spinning stability of the open-end spinning device, resulting in an especially protective treatment of the yarn since no additional mechanical loading of the yarn to be withdrawn is applied.

The wear protection sleeve, the twirling insert and the false twist blast nozzle device may be inserted into the central passage bore through an outlet side opposite the inlet side. Once installed, a removable locking element secures the components within the central passage bore of the conduit plate adapter.

For identification purposes, components of a particular conduit plate adapter can be rendered visible in a simple manner by a colored characterization of the conduit plate adapter or by a transponder that can be fixed in the central passage bore of the conduit plate adapter. Conduit plate adapters characterized in this manner can be unambiguously identified and can be readily inserted and replaced in accordance with the particular spinning operational requirements.

BRIEF DESCRIPTION OF THE DRAWINGS

Further features, embodiments, and advantages of the present invention will become apparent from the following detailed description with reference to the drawings, wherein.

DESCRIPTION OF THE PREFERRED EMBODIMENT

Figure 1:
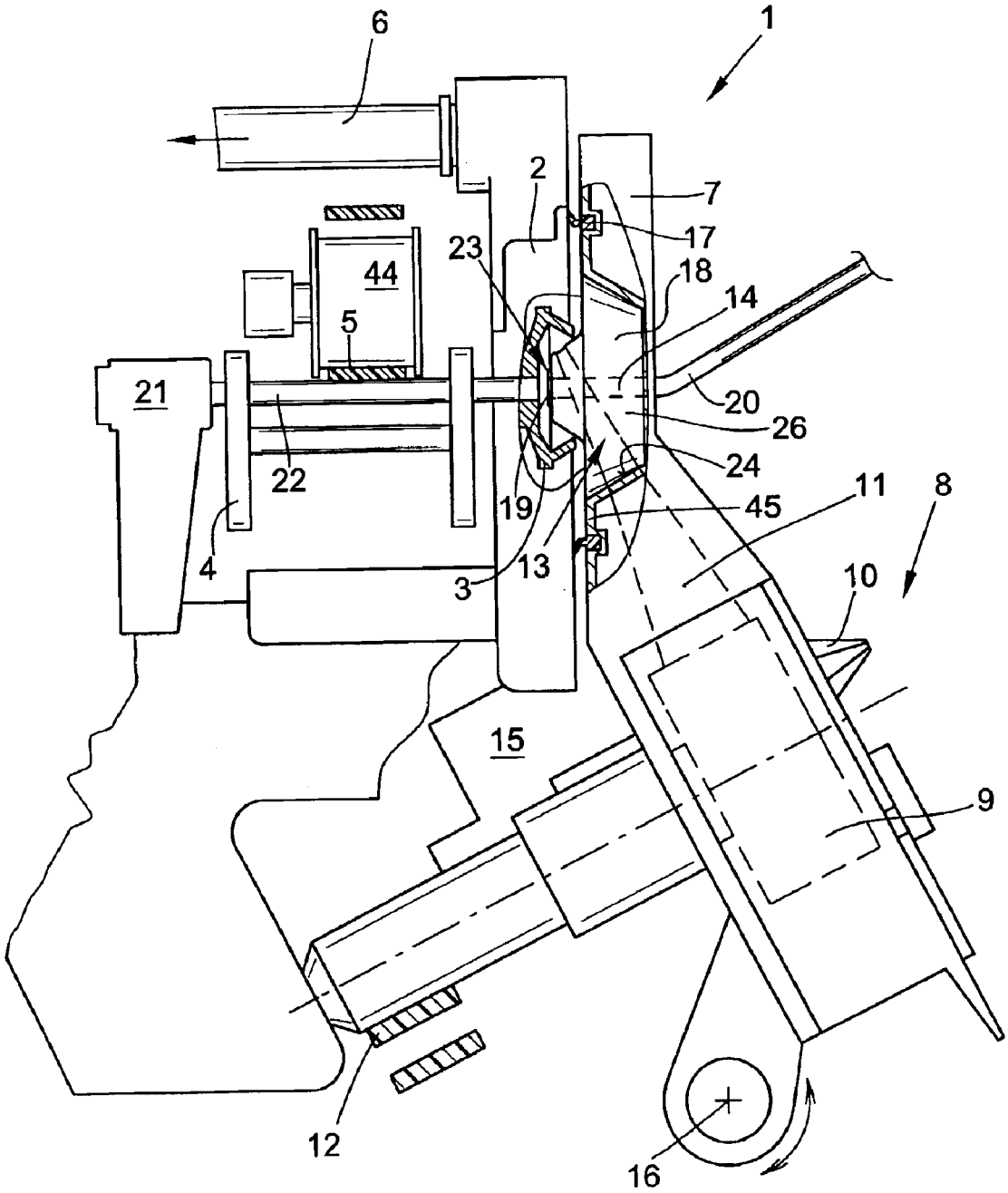
FIG. 1 is a partially cut-away side elevation view of an open-end spinning device employing a conduit plate adapter of the present invention.

Referring now to FIG. 1, an open-end spinning device 1 comprises a rotor housing 2 in which a spinning rotor 3 rotates at a high speed during the operation of spinning. Spinning rotor 3 is supported by a rotor shaft 22 rotating in bearing nips of a support bearing 4 and fixed in an axial direction, for example by a permanent magnetic axial bearing 21.

The spinning rotor 3 is typically driven by a tangential belt 5 that is applied to the rotor shaft 22 by a support roller 44. The rotor housing 2 is connected via a suction line 6 to a vacuum source (not shown). The rotor housing 2 is open toward a front of the open end spinning device 1. During spinning operation, the open end of the rotor housing 2 is closed by a fiber conduit plate 45 attached to a cover element 7. The cover element 7 rotates about a pivot shaft 16. When covering the rotor housing 2, the cover element 7 rests against and engages a lip sealing element 17 that is disposed on a front side of the rotor housing 2. The cover element 7, and the fiber conduit plate 45 attached thereto, may be rotated about the pivot shaft 16 to move away from the lip sealing element 17, thus opening the rotor housing 2.

The open-end spinning device 1 also includes a sliver delivery and opening device 8 integral to the cover element 7. The sliver delivery and opening device 8 comprises a sliver opening roller 9, a sliver intake cylinder 10 and a fiber guide conduit 11. The sliver opening roller 9 is typically driven by tangential belt 12 and the sliver intake cylinder 10 is powered by a drive shaft running the length of the machine or, as shown in FIG. 1, via an individual drive 15, preferably a stepping motor.

Receptacle 13, opening toward the spinning rotor 3, is disposed on the fiber conduit plate 45 and comprises a circular, conical contact surface 24. Conduit plate adapter 18 is fixed in a readily detachable manner and aligned in an angularly precise manner within the receptacle 13.

As shown in FIGS. 2–6, the conduit plate adapter 18 comprises a base body 26 and a central passage bore 14 extending completely through the base body 26. A yarn withdrawal nozzle 23 has a nozzle mouth 19 that is preferably manufactured from a ceramic material. The nozzle mouth 19 is fixed directly in an inlet side of the central passage bore 14 of the conduit plate adapter 18. A yarn withdrawal tube 20 is proximate to and engages an outlet side of the central passage bore 14.

Figure 2:
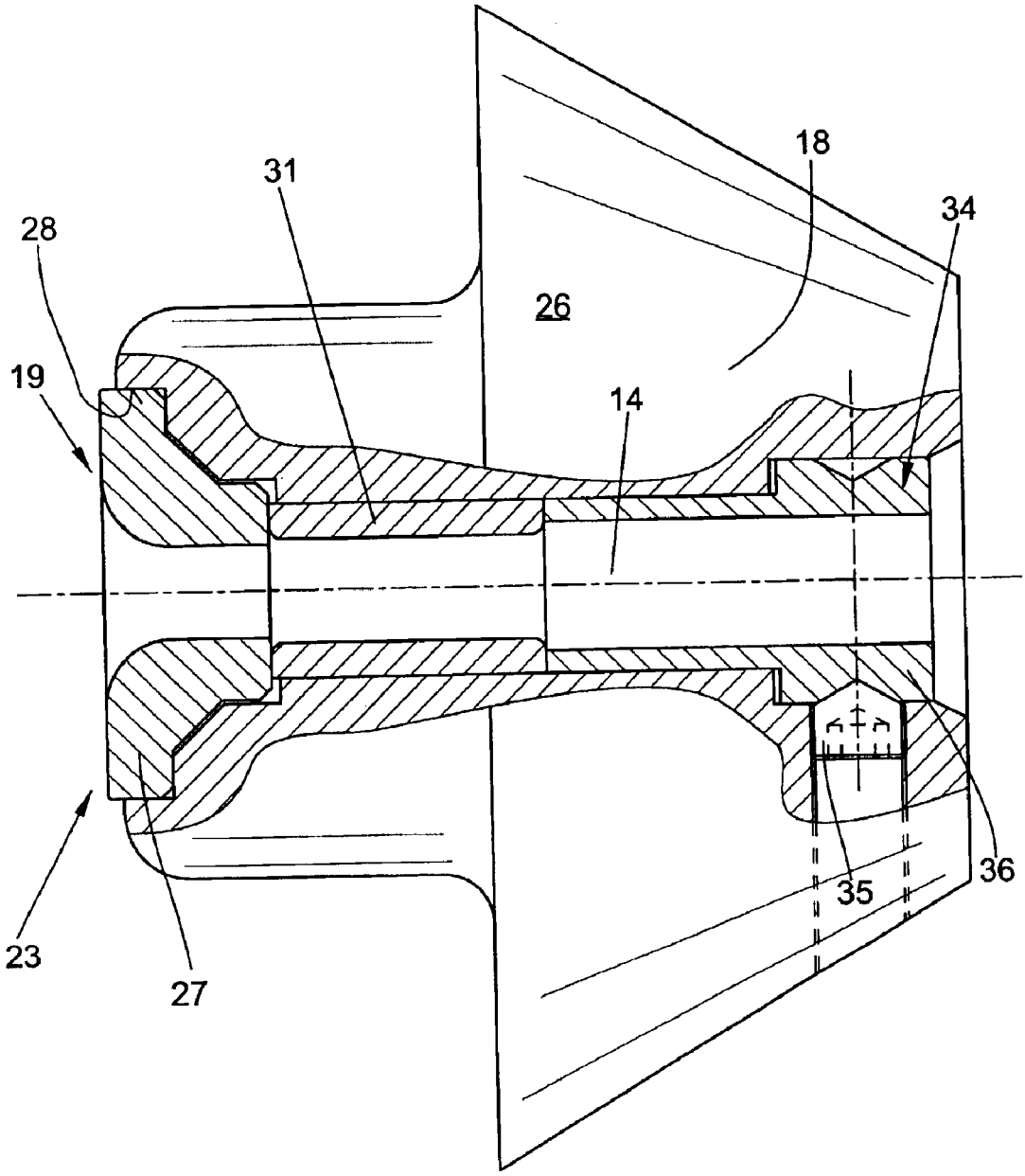
FIG. 2 is a partially cut-away side elevation view of the conduit plate adapter of the present invention, illustrating use of a wear protection sleeve.

As shown in FIG. 2, the inlet side of the central passage bore 14 is widened to form a receptacle opening 28 having a defined diameter. The nozzle mouth 19 includes a head 27 that has a defined outside diameter. In a preferred embodiment, the diameter of the head 27 of the nozzle mouth 19 is greater than the diameter of the receptacle opening 28. The head 27 is press fit into the receptacle opening 28, thus fixedly securing, in an undetachable manner, the nozzle mouth 19 to the central passage bore 14 of the conduit plate adapter 18. In another preferred embodiment, in which the diameter of the receptacle opening 28 is greater than the diameter of head 27 of nozzle mouth 19, the head 27 is fixedly secured to the opening receptacle 28 by an adhesive to form an undetachable connection that is very reliable and simple.

In a preferred embodiment, illustrated in FIG. 2, a wear protection sleeve 31 is disposed within the central passage bore 14 intermediate the nozzle mouth 19 and the outlet side of the central passage bore 14 opposite the nozzle mouth 19. The wear protection sleeve 31 is oriented along a direction of travel of the withdrawn yarn as it passes through the central passage bore 14 of the conduit plate adapter 18. The wear protection sleeve 31 protects the central passage bore 14 from being eroded due to abrasion caused by yarn traveling through the conduit plate adapter 18. The wear protection sleeve 31 is made of a wear resistant material, preferably a ceramic material, a hard metal or a plasma-nitrided material.

Figure 3:
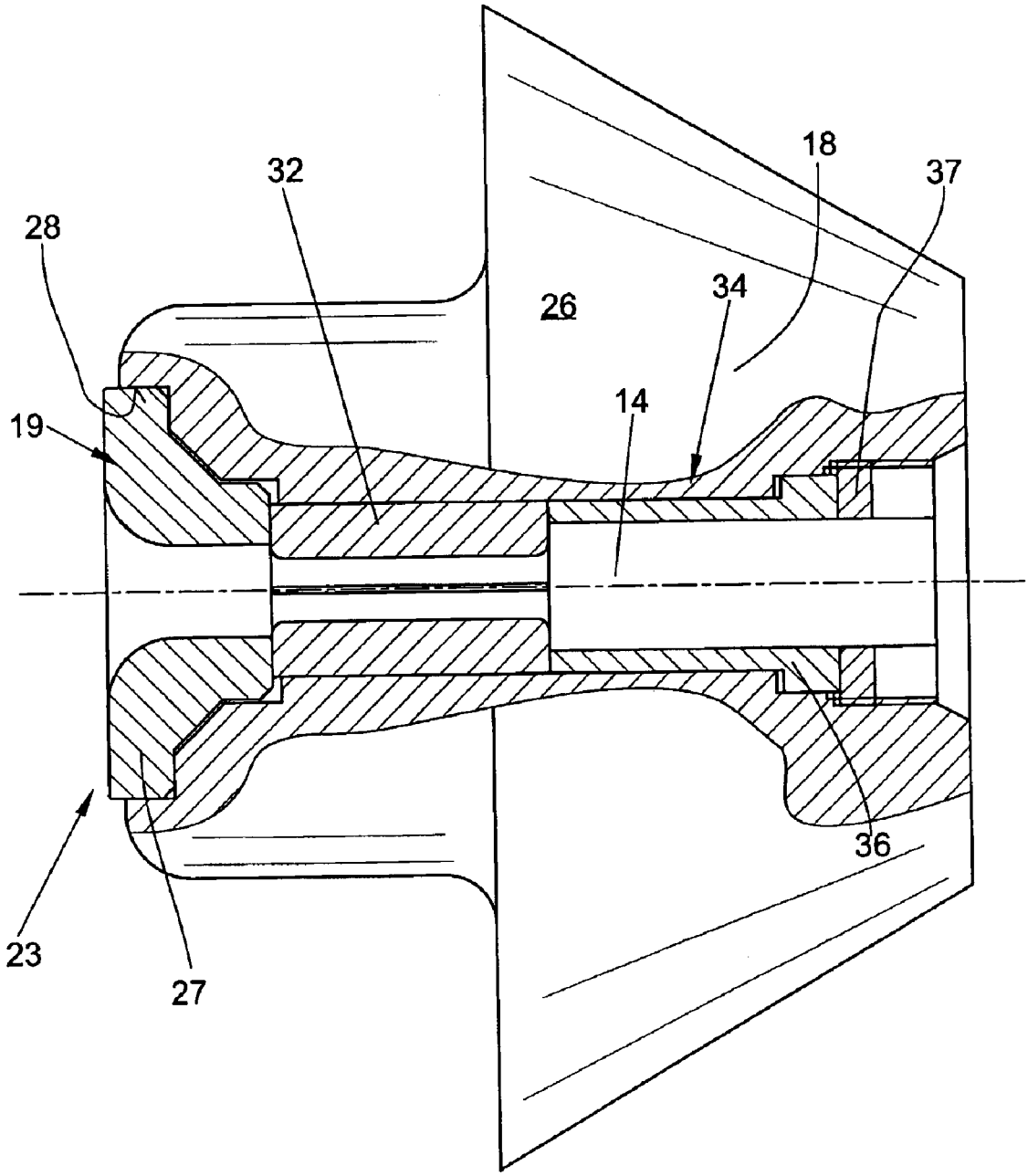
FIG. 3 is a cross-sectional view of the conduit plate adapter, illustrating use of a twirling insert in accordance with the present invention.

In another preferred embodiment, shown in FIG. 3, a twirling insert 32 is disposed with the central passage bore 14 intermediate the nozzle mouth 19 and the outlet side of the central passage bore 14 opposite the nozzle mouth 19. The twirling insert 32, oriented along the travel direction of the withdrawn yarn, imparts a mechanical false twist on the withdrawn yarn as it travels through the conduit plate adapter 18. In another preferred embodiment, both the wear protection sleeve 31 and the twirling insert 32 are disposed within the central passage bore 14.

Figure 6:
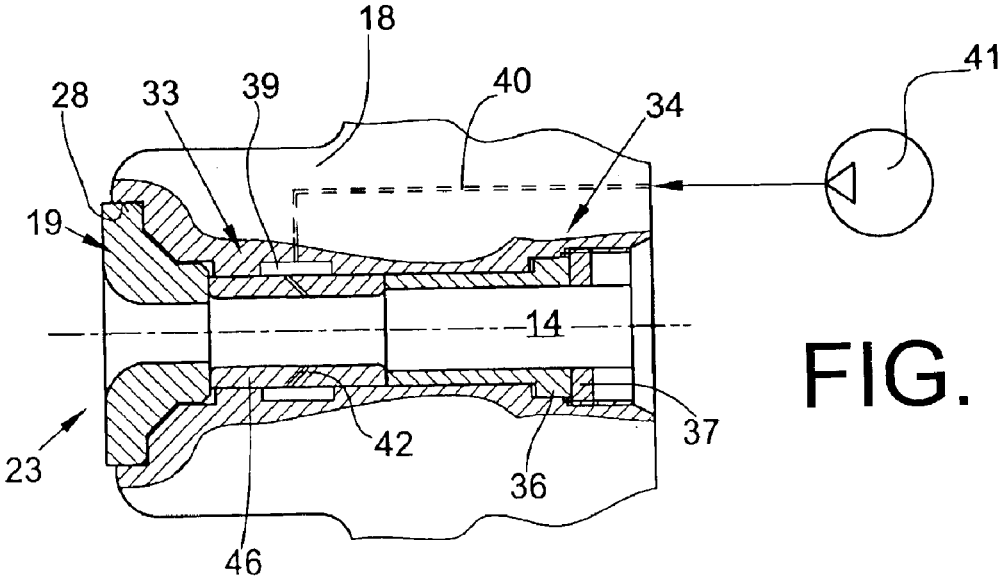
FIG. 6 is a cross-sectional view of the conduit plate adapter, illustrating use of a false twist blast nozzle device in accordance with the present invention.

In another preferred embodiment, shown in FIG. 6, a pneumatically operable false twist blast nozzle device 33 is used with the conduit plate adapter 18 to increase the false twist imparted to the withdrawn yarn, thus improving the spinning stability of the open-end spinning device 1. The false twist blast nozzle device 33 comprises a nozzle insert 46 having a plurality of tangential nozzle openings 42 integral therein, an annular plenum in fluid communication with the plurality of tangential nozzle openings 42, and an overpressurized gas source 41 connected to the annular plenum 39 via a pneumatic supply line 40 for supplying pressurized gas to the plurality of tangential nozzle openings 42. The nozzle insert 46 is disposed within the central passage bore 14 such that the plurality of tangential nozzle openings 42 are positioned at an angle within the central passage bore 14. During operation, pressurized gas supplied to the plurality of tangential nozzle openings 42 engages the withdrawn yarn as it travels through the conduit plate adapter 18, imparting a false twist thereon. In another preferred embodiment, both the wear protection sleeve 31 and the nozzle insert 46 of the false twist blast nozzle device 33 are disposed within the central passage bore 14.

A locking element 34 is used to releasably secure components—e.g., the wear protection sleeve 31, the twirling insert 32 and the nozzle insert 46—inside the central passage bore 14, as shown in FIGS. 2–6. The locking element 34, as shown in FIG. 2, comprising a locking sleeve 36 that is inserted into the central passage bore 14 and is held in place by a fastener 35 such as a set screw inserted through a hexagonal recessed hole into the locking sleeve 36. An alternative locking element 34, shown in FIG. 3, employs a threaded insert 37 that is installed after the locking sleeve 36 to secure the locking sleeve 36 within the central passage bore 14. Threads on an exterior of the threaded insert 37 engage and mesh with corresponding threads formed near the outlet side of the central passage bore 14, thus releasably securing the locking sleeve 36, and other internal components, within the central passage bore 14.

Figure 4:
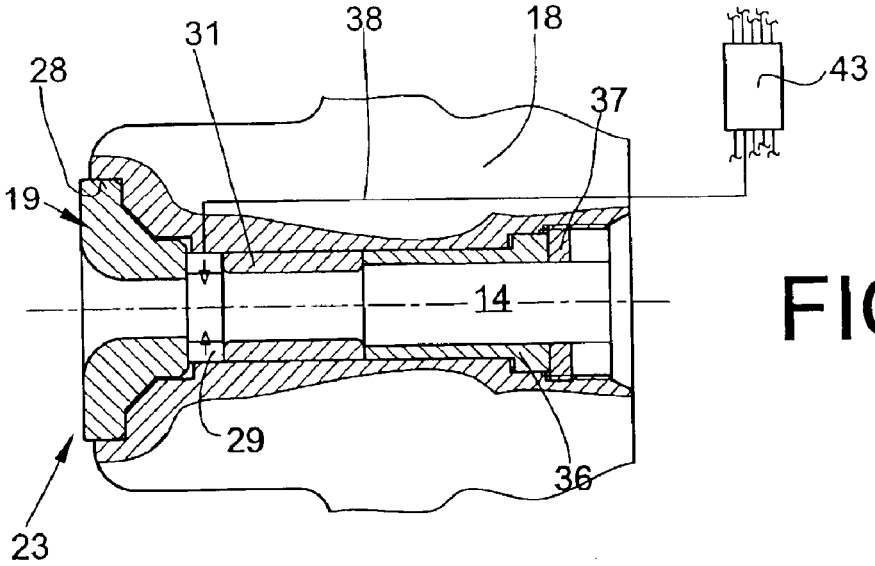
FIG. 4 is a cross-sectional view of the conduit plate adapter, illustrating use of a yarn monitoring sensor in accordance with the present invention.

A sensor 29 for monitoring the withdrawn yarn as it travels through the conduit plate adapter 18 is disposed within the central passage bore 14, as shown in FIG. 4. Preferably, the sensor 29 is installed in a protected manner between the nozzle mouth 19 and other devices (for example the wear protection sleeve 31) arranged in the central passage bore 14. The sensor 29, preferably designed as a thermosensor or a piezosensor, is connected to a control device 43 located on a workstation (not shown) via, for example, a signal line 38. The sensor 29 provides a reliable monitoring of the yarn withdrawn via nozzle mouth 19 during the operation of spinning.

Figure 5:
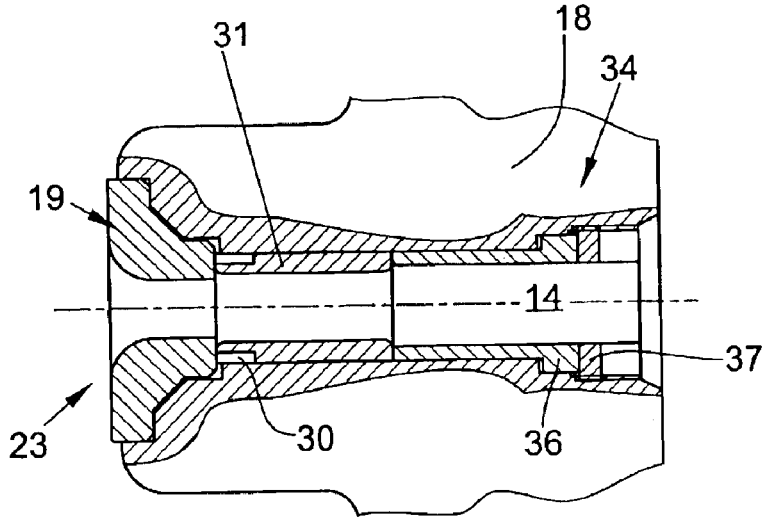
FIG. 5 is a cross-sectional view of the conduit plate adapter, illustrating use of an identification transponder in accordance with the present invention.

Another feature of the present invention is a transponder 30 that is disposed in the central passage bore 14, as shown in FIG. 5. The transponder 30 has a fixed, unambiguously identifiable recognition that furnishes information about the equipment of the particular conduit plate adapter 18. Preferably, the transponder 30 is placed between the nozzle mouth 19 and other devices within the central passage bore 14, for providing the wear protection 31, so that the transponder is secured within the central passage bore 14.

An alternative identification system for the conduit plate adapter 18 comprises a color coding of the conduit plate adapter 18. For example, the conduit plate adapter 18 may have a colored marking from which the components and configuration of a particular conduit plate adapter 18 can be readily and unambiguously ascertained.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A conduit plate adapter for an open-end rotor spinning device comprising a base body insertable into a receptacle of a conduit plate, and a nozzle mouth that is arranged in only an inlet portion of a central passage bore of the base body, wherein the nozzle mouth is fixedly secured non-detachable to the inlet portion of the central passage bore of the base body.

2. The conduit plate adapter according to claim 1, wherein the nozzle mouth is press fit into a receptacle opening arranged at an inlet side of the central passage bore.

3. The conduit plate adapter according to claim 1, wherein the nozzle mouth is secured by adhesive to a receptacle opening arranged at an inlet side of the central passage bore.

4. The conduit plate adapter according to claim 1, further comprising a sensor attached to a portion of the central passage bore for monitoring running yarn traveling through the central passage bore.

5. The conduit plate adapter according to claim 1, further comprising a transponder arranged on a portion of the central passage bore, the transponder identifying the conduit plate adapter.

6. The conduit plate adapter according to claim 1, further comprising a wear protection sleeve arranged within the central passage bore and oriented along a direction of travel of a yarn run through the central passage bore from the nozzle mouth.

7. The conduit plate adapter according to claim 1, further comprising a twirl insert arranged within the central passage bore and oriented along a direction of travel of a yarn traveling through the central passage bore from the nozzle mouth.

8. The conduit plate adapter according to claim 1, further comprising a false twist blast nozzle device arranged in the central passage bore and oriented along a direction of travel of a yarn run traveling through the central passage bore from the nozzle mouth.

9. The conduit plate adapter according to claim 6, wherein the wear protection sleeve is replaceable.

10. The conduit plate adapter according to claim 9, wherein the wear protection sleeve is secured within the central passage bore by a detachable locking insert.

11. The conduit plate adapter according to claim 7, wherein the twirl insert is replaceable.

12. The conduit plate adapter according to claim 11, wherein the twirl insert is secured within the central passage bore by a detachable locking insert.

13. The conduit plate adapter according to claim 8, wherein the false twist blast nozzle device is replaceable.

14. The conduit plate adapter according to claim 13, wherein the false twist blase nozzle device is secured within the central passage bore by a detachable locking insert.

15. The conduit plate adapter according to claim 6, wherein the wear protection sleeve is made of a ceramic material, a hard metal, or a plasma-nitrided material.

16. The conduit plate adapter according to claim 6, further comprising a twirl insert arranged within the central passage bore and oriented along a direction of travel of a yarn run traveling through the central passage bore from the nozzle mouth.

17. The conduit plate adapter according to claim 8, wherein the false twist blast nozzle device comprises:

a nozzle insert positioned within the central passage bore;

a plurality of tangential nozzle openings extending through the nozzle insert for fluid engagement of a yarn run traveling through the central passage bore;

an annular conduit connected to the plurality of tangential nozzle openings opposite the nozzle insert; and an overpressure source connected to the annular conduit by a pneumatic line.

18. The conduit plate adapter according to claim 1, wherein the nozzle mouth is a ceramic material.

19. The conduit plate adapter according to claim 1, wherein components of the conduit plate adapter are rendered visible by a colored characterization.

20. In an open-end rotor spinning device, a conduit plate adapter removably affixable in a receptacle of a conduit plate, the conduit plate adapter comprising:

a base body insertable into said receptacle, the base body having a central passage bore extending therethrough; and a nozzle mouth of a yarn withdrawal nozzle arranged in only an inlet portion of the central passage bore of the base body, wherein the nozzle mouth is fixedly secured non-detachable to the inlet portion of the central passage bore of the base body.

* * * * *